US006835763B2

(12) United States Patent
Ellis et al.

(10) Patent No.: US 6,835,763 B2
(45) Date of Patent: Dec. 28, 2004

(54) LIGHTWEIGHT MATERIAL FOR PROTECTIVE PADS, CUSHIONS, SUPPORTS OR THE LIKE AND METHOD

(75) Inventors: Edward J. Ellis, Lynnfield, MA (US); Theodore B. Brother, Andover, MA (US)

(73) Assignee: I-TEK, Inc., Lawrence, MA (US)

( * ) Notice: Subject to any disclaimer, the term of this patent is extended or adjusted under 35 U.S.C. 154(b) by 375 days.

(21) Appl. No.: 09/911,318

(22) Filed: Jul. 23, 2001

(65) Prior Publication Data

US 2002/0161070 A1 Oct. 31, 2002

Related U.S. Application Data

(60) Provisional application No. 60/265,763, filed on Feb. 1, 2001.

(51) Int. Cl.[7] ..... C08J 9/32
(52) U.S. Cl. ..... 523/218; 523/219
(58) Field of Search ..... 523/218, 219

(56) References Cited

U.S. PATENT DOCUMENTS

| | | | | |
|---|---|---|---|---|
| 3,529,368 A | 9/1970 | Canfield | 36/2.5 |
| 3,748,669 A | 7/1973 | Warner | 5/348 WB |
| 3,986,213 A | 10/1976 | Lynch | 3/36 |
| 4,038,762 A | 8/1977 | Swan, Jr. | 36/89 |
| 4,229,546 A | 10/1980 | Swan, Jr. | 521/55 |
| 4,252,910 A | 2/1981 | Schaefer | 521/145 |
| 4,728,551 A | 3/1988 | Jay | 428/76 |
| 4,952,439 A | 8/1990 | Hanson | 428/72 |
| 5,058,291 A | 10/1991 | Hanson | 36/117 |
| 5,093,138 A | 3/1992 | Drew et al. | 426/68 |
| 5,100,712 A | 3/1992 | Drew et al. | 428/68 |
| 5,147,685 A | 9/1992 | Hanson | 428/189 |
| 5,204,154 A | 4/1993 | Drew et al. | 428/68 |
| 5,362,543 A | 11/1994 | Nickerson | 428/76 |
| 5,421,874 A | 6/1995 | Pearce | 106/122 |
| 5,549,743 A | 8/1996 | Pearce | 106/122 |
| 5,626,657 A | 5/1997 | Pearce | 106/122 |
| 5,869,164 A | 2/1999 | Nickerson et al. | 428/76 |
| 6,020,055 A | 2/2000 | Pearce | 428/323 |
| 6,026,527 A | 2/2000 | Pearce | 5/654 |
| 6,583,199 B2 * | 6/2003 | Brother et al. | 523/204 |

* cited by examiner

*Primary Examiner*—Edward J. Cain
(74) *Attorney, Agent, or Firm*—Nields & Lemack

(57) ABSTRACT

An improved material for use in resilient conforming pads, cushions, impact resistance padding and the like is described. The material comprises hollow micro particles cohered to a mass by a combination of low and high molecular weight thermoplastic bonding agents. The material is useful for providing low weight contour conforming resilient padding for garments, athletic equipment, prosthetic devices, surgical or vehicular cushions, positioning devices, mattresses impact protective padding and the like.

10 Claims, 2 Drawing Sheets

LIGHTWEIGHT MATERIAL FOR PROTECTIVE PADS, CUSHIONS, SUPPORTS OR THE LIKE AND METHOD

This application claims the benefit of provisional application Ser. No. 60/265,763 filed Feb. 1, 2001.

BACKGROUND OF THE INVENTION

A wide variety of compositions have been developed for use in seats, cushions mattresses, fitting pads, athletic equipment (including impact absorbing materials), prosthetic devices and similar apparatus which are placed in contact with the human body. Such compositions provide form support, comfort and protection because they have the ability to deform in response to continuously applied pressure or the ability to absorb significant amounts of energy from rapidly applied pressure (impact). In addition, it is a desirable feature for these compositions to be lightweight. This can be achieved to some degree by employing foams or composite materials.

A review of the prior art reveals many examples of materials for use in cushioning and padding applications. These materials generally fall into one or two categories: conventional foams and viscous liquids.

Foams offer the advantages of low cost, lightweight and the ability to exhibit a wide variety of physical properties such as: flexible to rigid, instantaneous or delayed recovery and closed or open cell (breath ability). On the other hand, foams do not flow and therefore are not pressure compensating. In addition, foams do not dissipate energy in impact situations.

Viscous liquids may be either water based or oil based. Generally water based systems are produced by dissolving a water-soluble polymer to increase the viscosity to produce a thick flowable liquid or a gel. While these systems offer pressure compensation in applications such as conforming cushions, they have a specific gravity of about 1.0 versus foams which can be produced with specific gravity of 0.2 or less. Water based systems, when used in cushioning applications, must be protected against evaporation, freezing and microbial growth. Use of an oil-based system overcomes the deficiencies noted for water-based systems. Examples of oil-based materials would include silicon oils, hydrocarbon oils, mineral oil and synthetic polymers such a polyamides and polyglycols. The useful viscosity range for these oils range from about 1,000 to up to 1,000,000 centipoise, depending on the application and the components that are utilized in formulation.

U.S. patents to Terrence M. Drew et al. issued Mar. 3, 1992 (U.S. Pat. No. 5,093,138) and Mar. 31, 1992 (U.S. Pat. No. 5,100,712) describe a flowable, pressure compensating composition including water, a material for increasing the viscosity of water, and spherical particles dispersed throughout the volume of the water. The composition disclosed in these patents is a deformable fluid that has the disadvantages of substantial weight, memory, and being slow to flow or shear in response to a deforming pressure.

U.S. patents to Chris A. Hanson issued Oct. 22, 1991 (U.S. Pat. No. 5,058,291) and Aug. 28, 1990 (U.S. Pat. No. 4,952,439) describe padding devices, which are resistant to flow in response to an instantly applied pressure. The composition of the padding material is a combination of wax and discrete particles, including microspheres. The padding disclosed in these patents has the disadvantage of being slow to flow in response to pressure, thus having a high shearing force. The materials disclosed in these patents also have memory, causing them to tend to return to their original shape after removal of a deforming pressure. Memory is described in U.S. patents to Chris A. Hanson issued Sep. 15, 1992, (U.S. Pat. No. 5,147,685), Terrence M. Drew issued Apr. 20, 1993 (U.S. Pat. No. 5,204,154), Chris A. Hanson issued Aug. 28, 1990 (U.S. Pat. No. 4,952,439), Thomas F. Canfield issued Sep. 22, 1970 (U.S. Pat. No. 3,529,368), Terrence M. Drew et al. issued Mar. 3, 1992 (U.S. Pat. No. 5,093,138), Chris A. Hanson issued Oct. 22, 1991 (U.S. Pat. No 5,058,291) and Terrence M. Drew, et al. issued Mar. 31, 1992 (U.S. Pat. No. 5,100,712).

U.S. patents to Eric C. Jay issued Mar. 1, 1998 (U.S. Pat. No. 4,728,551), Jack C. Swan, Jr. issued Oct. 21, 1980 (U.S. Pat. No. 4,229,546), Jack C. Swan, Jr. issued Aug. 2, 1977 (U.S. Pat. No. 4,038,762), Henry Winfred Lynch issued Oct. 19, 1976 (U.S. Pat. No. 3,986,213) and Frederick L. Warner issued Jul. 31, 1973 (U.S. Pat. No. 3,748,669), disclose pressure-compensating mixtures, which are generally characterized by having a quantity of micro beads dispersed in a flowable liquid medium.

Disadvantages of such mixtures include their weight, head pressure and memory. The liquid described in those patents is formulated for certain flow characteristics and the micro beads are merely added because of their low specific gravity to reduce the total weight of the mixture. The resulting mixture is still very heavy because the light micro beads are not used to replace a substantial amount of the heavy liquid, but are instead used only to provide a slight weight reduction of the mixture compared to the use of a liquid alone.

U.S. patents to Tony M. Pearce issued Jun. 6, 1995 (U.S. Pat. No. 5,421,874), Aug. 27, 1996 (U.S. Pat. No. 5,549,743), May 6, 1997 (U.S. Pat. No. 5,626,657), Feb. 1, 2000 (U.S. Pat. No. 6,020,055), describe a composite mixture of spherical objects and lubricant useful for its cushioning properties. The composite may be composed of microspheres and any of a variety of lubricants that involves sliding and rolling contact of the spherical particles with respect to each other. This creates a situation where interactions between spherical particles are avoided. The result is the inability to transfer localized loading through out the composite material and can lead to 'bottoming out' of the cushion or padding device.

U.S. patent to Lincoln P. Nickerson, issued Nov. 8, 1994 (U.S. Pat. No. 5,362,543), describes a composite composition comprising a silicone fluid with an amide thickener filled with glass or phenolic micro-spheres. Their compositions are particularly characterized by their ability to flow in response to a continuously applied pressure, yet to maintain their shape and position in the absence of applied pressure.

The use of block copolymers in padding and cushioning compositions is described in U.S. patents issued to Terry M. Pearce, issued Feb. 22, 2000 (U.S. Pat. No. 6,026,527), and to Lincoln P. Nickerson issued Feb. 9, 1999 (U.S. Pat. No. 5,869,164). These patents disclose the use of ABA type Block copolymers, generally composed of one block of polystyrene and the other block of a soft rubber like elastomer. The addition of these block copolymers to oil based vehicles results in a thixotropic fluid. Microspheres are utilized to lower the density of these compositions.

U.S. patent to Philip Schaefer, issued Feb. 24, 1981 (U.S. Pat. No. 4,252,910) describes a material for use in resilient conforming pads, cushions and the like. The material comprises plastic micro-spheres cohered to a mass by a thermoplastic bonding agent. The bonding agent is a polybutene polymer in the molecular weight range of 3,000 to 7,500.

Given this relatively narrow molecular weight range the viscous-elastic properties of the Schaefer composition are rather limited. In fact Schaefer states that the bonding agent is flowable plastic at about, or slightly higher than body temperature. Given these conditions and restrictions the Schaefer invention is quite limited in its scope.

SUMMARY OF THE INVENTION

The present invention is directed to improved, lightweight compositions for padding and cushioning devices. These compositions comprise three components: a paraffinic-based fluid, as a vehicle; micro-spheres, as a lightweight included phase; and a high molecular weight rheological modifier. Furthermore, it is an important aspect of this invention that both the fluid based vehicle and the rheological modifier provide a degree of bonding or adhesion to the microspheres to provide a means of attaining improved response and distribution of mechanical loads. In addition, improved bonding or adhesion also provides for better stability of the composition, that is, better resistance to separation of the microspheres from continuous vehicle phase.

A variety of fluids can be used as the vehicle. The preferred fluids are saturated polyalphaolefins, paraffinic mineral oils and polybutene fluids including polyisobutylene and poly-1-butene.

Microspheres serve to significantly lower the density of the composite material. Preferred microspheres include those formed from phenolic or other plastic materials, glass or ceramic materials. Plastic microspheres are generally preferred because they are considerably lighter than glass or ceramic microspheres. Plastic microspheres offer additional benefits in that they can undergo instantaneous compression and recovery for impact padding uses.

The rheological modifying agent of this invention is polybutene having a molecular weight of about 750,000 to about 5,000,000, preferably about 1,000,000 to about 2,000,000, most preferably about 1,000,000.

The compositions of the present invention are especially useful as filling materials for deformable, pressure compensating padding devices comprising a flexible protective envelope having a cavity which contains the composition and which envelope has structure that allows the composition to deform in the cavity in response to a continuously applied load upon said envelope, but to maintain position in the absence of pressure.

In the case where the applied load is instantaneous, such as in impact, said envelope deforms minimally and the transferred energy is effectively dissipated by the contained composition. The compositions of the present invention are particularly characterized by their:

1. Ability to deform by flowing in response to a continuously applied pressure.
2. Ability to dissipate or absorb the kinetic energy, which results from an impact event.
3. Tendency to maintain shape and position in the absence of an applied pressure.
4. Lack of resiliency, under loading normally associated with materials such foams or elastomers.
5. Minor changes in viscosity when subjected to changes in temperature.
6. Resistance to phase separation of the vehicle and microsphere components.
7. Chemical compatibility with vinyl, polyurethane and polyolefin films.
8. Excellent biocompatibility that is non-poisonous and low probability of contact dermatitis.
9. Low potential for microbial growth.
10. Stable over time, that is, long shelf life.

DESCRIPTION OF PREFFERED EMBODIMENTS

Over the past few decades it has become very clear that many properties of polymer systems are not only influenced by the average molecular weight but also the width and the shape of the molecular weight distribution (MWD).

A MWD can be considered to be reasonably characterized when at least three different molecular weights, the number average $\overline{M}_n$, the weight average $\overline{M}_w$ and the z-average $\overline{M}_z$, are known. These averages are defined as follows:

$$\overline{M}_n = \frac{\sum N_i M_i}{\sum N_i} = \frac{W}{N}$$

$$\overline{M}_w = \frac{\sum N_i M_i^2}{\sum N_i M_i} = \sum w_i M_i$$

$$\overline{M}_z = \frac{\sum N_i M_i^3}{\sum N_i M_i^2} = \frac{\sum w_i M_i^2}{\sum w_i M_i}$$

where $N_i$=number of molecules of molecular weight $M_i$

Figure 1:
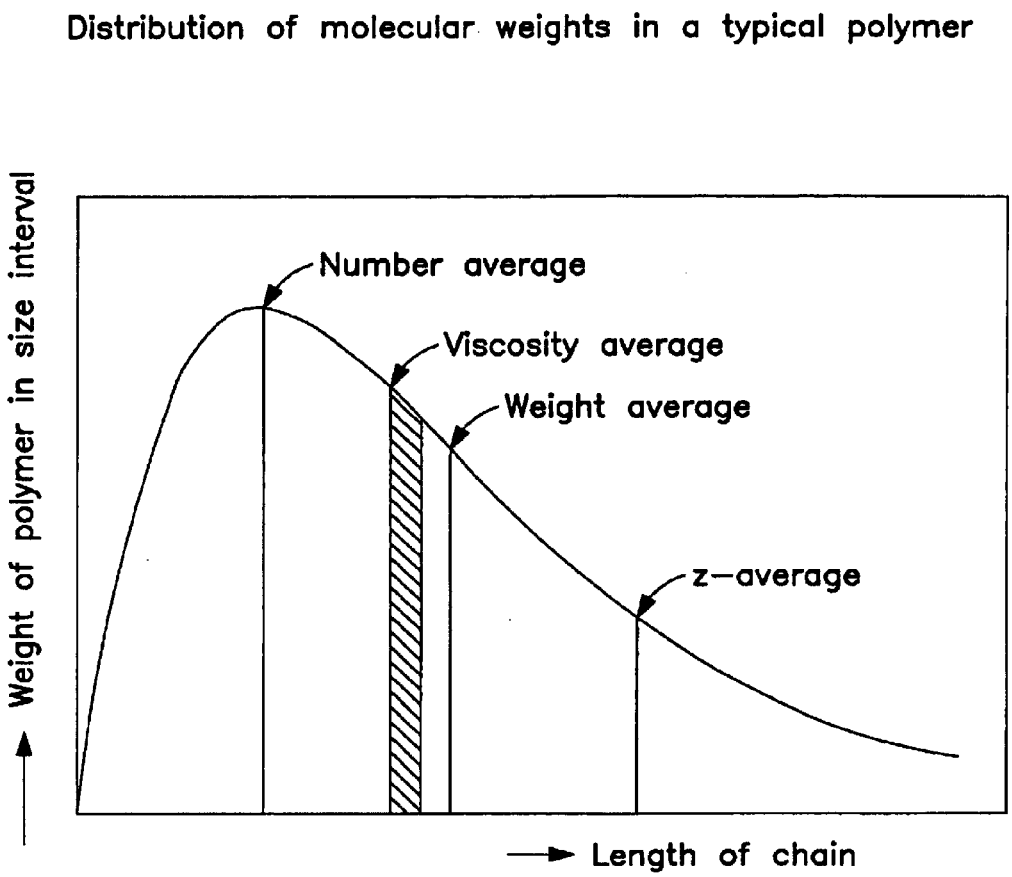
FIG. 1 is a graph showing the distribution of molecular weight in a typical polymer.

N=total number of molecules $W_i$=weight fraction of molecules of molecular weight $M_i$ W=total weight FIG. 1 shows a molecular weight distribution curve. Characteristic ratios are $$Q = \frac{\overline{M}_w}{\overline{M}_n} \text{ and } Q' = \frac{\overline{M}_z}{\overline{M}_w}.$$

Q=Q'=1 would correspond to a perfectly uniform or monodisperse polymer. A high Q-ratio points to a low molecular weight tail, whereas a high Q'-ratio indicates the presence of very high molecular weight material. Q may range from 1.5–2.0 to 20–50 in practice (the lower values for condensation polymers, the higher values for radical-chain addition polymers).

The basic reason is that some properties, including tensile and impact strength, are specifically governed by the short molecules; for other properties, such as solution viscosity and low shear melt flow, the influence of the middle class of the chains is predominant; other properties again such as melt elasticity are strongly dependent on the amount of the longest chains present.

From both theory and practice it is evident that visco-elastic or rheological properties of polymer systems are greatly influenced by the presence of very high molecular weight polymer species. For example, typical visco-elastic property, such as fluid elasticity, depends on the z-average molecular weight.

In fact, addition of just a small fraction of very high molecular polymer to a very low molecular weight polymer will greatly alter the visco-elastic response of that polymer system.

We have utilized this concept to produce the novel compositions of this invention.

One object of this invention is to provide for improved visco-elasticity of the vehicle component of or composition, yet have a minimal affect on the viscosity of the vehicle.

Another object of this invention is to provide improved adhesion or bonding of the vehicle phase to the microspheres through the use of the high molecular weight rheological modifier.

Table 1 below gives some approximate useable and preferred ranges, by weight, for the components of the composition of the present invention.

TABLE 1

GENERAL FORMULATIONS

| INGREDIENT | USABLE RANGE | PREFERRED RANGE |
|---|---|---|
| Low molecular wt. vehicle | 30–95 | 50–95 |
| High molecular wt. modifier | 0.01–3.0 | 0.1–0.5 |
| Microspheres | | |
| Plastic | 1.0–20 | 2.0–15 |
| Glass | 1.0–65 | 5.0–40 |

Preferably the vehicle or continuous phase of the compositions of this invention are paraffinic fluids which include, but not limited to, mineral oil, polyalphaolefin fluids and polybutene fluids, more preferably the vehicle phase is polybutene oil.

The high molecular weight rheological modifier is polybutene of molecular weight about 750,000 to about 5,000,000 Daltons. Preferably this polymer is dissolved in low molecular weight fluid such as mineral oil or polybutene fluid for ease of handling.

The microspheres of this invention are discrete micron sized particles the size of the microspheres will preferably be within the size range of about 10 to about 300 microns. It is generally preferred to use from about 2 to about 15 percent by weight of light plastic microspheres, either non-coated or surface coated such as with calcium carbonate, or about 5 to about 40 percent by weight in the case of glass or ceramic microspheres.

The density of the microspheres generally will be between about 0.025 and about 0.80 g/cc. Microspheres serve as density-reducing components of the compositions. Therefore, the weight of the microspheres in most cases will be lower than the combined weight of all of the other components. Although plastic microspheres are preferred, glass, phenolic, carbon, ceramic or other microspheres may be used in the compositions of the present invention. The volume of the microspheres in the deformable pressure-compensating compositions affects the overall viscosity of these compositions. The maximum theoretical loading for spherical microspheres of the same size, with nearly perfect packing of the microspheres, is about 74% by volume. However, the maximum loading of the microspheres in the herein described compositions is less than this theoretical maximum, and preferably a microspheres loading is from about 40 to about 60 volume percent. For the lightest formulations, depending on the microspheres density, it is preferred to load to this volumetric percentage. Weight percentages will depend of the relative densities of the microspheres and thixotropic fluid.

Plastic (i.e. copolymer or acrylic) microspheres have densities in the 0.025–0.15 g/cc range.

Glass microspheres generally have densities in the 0.15–0.8 g/cc range. Phenolic microspheres have densities in the 0.15–0.25 g/cc range. Obviously, such differences can have rather significant effects on the overall densities of the final deformable compositions, which may range from about 0.30 to 0.95 g/cc. With such differences in the densities of the microspheres, the microspheres weight proportion of the overall composition can say considerably.

Plastic microspheres are generally preferred because they are considerably lighter than glass or ceramic. The specifically preferred microspheres are pre-expanded and have a PAN/PMMA or PVDC/PAN (polyacrylonitrile) and polymethylmethacrylate or polysinglidene dichloride) shell surrounding a butane gas blowing agent. They are sold by Nobel Industries under the commercial name Expancel® microspheres.

The lightweight compositions of the present invention are preferably prepared in the following manner. Firstly, the high molecular weight polybutene is blended and dissolved in a low molecular weight polybutene fluid. This requires raising the temperature of the fluid to about 75° C., adding the high molecular weight polybutene in crumb or pill form and applying shearing action until the polybutene dissolves. The ratio of low molecular fluid to high molecular weight polybutene is 90/10 to 97/03. Once dissolved the resulting solution is clear and extremely viscous.

The composite material is produced with a low shear-mixing device such as a dough mixer or a ribbon blender. The vehicle 1 phase is added to the mixer followed by the high molecular weight polybutene solution. Once these components are thoroughly mixed the microspheres are added. Mixing is continued until the microspheres are completely dispersed.

The resulting low-density composite material may be in the form of a viscous liquid to a 'dry' fluffy consistency.

FORMULATION MATERIALS

| CODE | DESCRIPTION |
|---|---|
| PB 450 | Polybutene of molecular weight 420 |
| PB 700 | Polybutene of molecular weight 700 |
| PB 950 | Polybutene of molecular weight 950 |
| VHMW | Polybutene (1,000,000 MW) in low MW Polybutene, 50/50 |
| MS 40 | PVDC microspheres 30–50 microns in diameter |
| MS 30 | CAN coated microsphere 20–40 micron in diameter |

The following examples will serve to illustrate the compositions of this invention. It is understood that these examples are set forth merely for illustrations purposes and many other compositions are within the scope of the present invention. Those skilled in the art will recognize that composition containing other quantities of material and different species of the required material may be proposed.

EXAMPLE 1

The following example details the process for producing the composite materials of this invention. To a low shear mixer, such as a dough mixer or ribbon blender, add the vehicle fluid either at room temperature or at a temperature up to 100° C. Use of higher temperatures lowers the viscosity of the vehicle fluid that promotes better mixing.

The high molecular weight modifier is then added to the vehicle and mixed until a uniform solution results. At this point the microspheres are added to the modified vehicle and mixing is continued until the microspheres are uniformly dispersed and well bonded to the vehicle/modifier phase. The resulting composite material is then stored until use.

EXAMPLE 2

The following formulations, in grams, were prepared by the method outlined in Example 1.

| | FORMULATION | |
|---|---|---|
| | A | B |
| PB450 | 1100 | 1075 |
| VHMW | 0 | 25 |
| MS40 | 100 | 100 |
| STABILITY | Separates | stable |
| ELASTICITY | None | high |

The results show that addition of the high molecular weight modifier prevents separation of the microspheres from the vehicle indicating improved adhesion or bonding of the microspheres to the vehicle due to the modifier.

In addition, Formulation B exhibited vastly improved elasticity over the central, Formulation A, as evidence by the ability of Formulation B to resist pull-apart and the formation of "strings" during pull-apart. This indicates that the high molecular weight modifier has imported a high degree of cohesion and elasticity to the composition.

EXAMPLE 3

The following formulations, in grams, were prepared by the method outlined in Example 1.

| | FORMULATION | |
|---|---|---|
| | A | B |
| PB450 | 1200 | 1175 |
| VHMW | 0 | 25 |
| MS40 | 100 | 100 |
| STABILITY | separates | stable |
| ELASTICITY | none | high |

The results show that addition of the high molecular weight modifier prevents separation of the microspheres from the vehicle indicating improved adhesion or bonding of the microspheres to the vehicle due to the modifier.

In addition, Formulation B exhibited vastly improved elasticity over the central, Formulation A, as evidence by the ability of Formulation B to resist pull-apart and the formation of strings during pull-apart. This indicates that the high molecular weight modifier has imported a high degree of cohesion and elasticity to the composition.

EXAMPLE 4

The following formulations, in grams, were prepared by the method outlined in Example 1.

| | FORMULATION | |
|---|---|---|
| | A | B |
| PB700 | 1200 | 1470 |
| VHMW | 0 | 30 |
| MS40 | 100 | 100 |
| STABILITY | separates | stable |
| ELASTICITY | none | high |

The results show that addition of the high molecular weight modifier prevents separation of the microspheres from the vehicle indicating improved adhesion or bonding of the microspheres to the vehicle due to the modifier.

In addition, Formulation B exhibited vastly improved elasticity over the central, Formulation A, as evidence by the ability of Formulation B to resist pull-apart and the formation of "strings" during pull-apart. This indicates that the high molecular weight modifier has imported a high degree of cohesion and elasticity to the composition.

EXAMPLE 5

The following formulations, in grams, were prepared by the method outlined in Example 1.

| | FORMULATION | |
|---|---|---|
| | A | B |
| PB450 | 700 | 680 |
| PB700 | 600 | 580 |
| VHMW | 0 | 40 |
| MS40 | 100 | 100 |
| STABILITY | separates | stable |
| ELASTICITY | none | very high |

The results show that addition of the high molecular weight modifier prevents separation of the microspheres from the vehicle indicating improved adhesion or bonding of the microspheres to the vehicle due to the modifier.

In addition, Formulation B exhibited vastly improved elasticity over the central, Formulation A, as evidence by the ability of Formulation B to resist pull-apart and the formation of "strings" during pull-apart. This indicates that the high molecular weight modifier has imported a high degree of cohesion and elasticity to the composition.

EXAMPLE 6

The following formulations, in grams, were prepared by the method outlined in Example 1.

| | FORMULATION | |
|---|---|---|
| | A | B |
| PB450 | 1000 | 980 |
| VHMW | 0 | 20 |
| MS40 | 200 | 200 |
| STABILITY | separates | stable |
| ELASTICITY | none | high |

The results show that addition of the high molecular weight modifier prevents separation of the microspheres from the vehicle indicating improved adhesion or bonding of the microspheres to the vehicle due to the modifier.

In addition, Formulation B exhibited vastly improved elasticity over the central, Formulation A, as evidence by the ability of Formulation B to resist pull-apart and the formation of "strings" during pull-apart. This indicates that the high molecular weight modifier has imported a high degree of cohesion and elasticity to the composition.

EXAMPLE 7

The following formulations, in grams, were prepared by the method outlined in Example 1.

| | FORMULATION | |
|---|---|---|
| | A | B |
| PB950 | 1400 | 1355 |
| VHMW | 0 | 45 |
| MS40 | 100 | 100 |
| STABILITY | Separates | stable |
| ELASTICITY | slight | high |

The results show that addition of the high molecular weight modifier prevents separation of the microspheres from the vehicle indicating improved adhesion or bonding of the microspheres to the vehicle due to the modifier.

In addition, Formulation B exhibited vastly improved elasticity over the central, Formulation A, as evidence by the ability of Formulation B to resist pull-apart and the formation of "strings" during pull-apart. This indicates that the high molecular weight modifier has imported a high degree of cohesion and elasticity to the composition.

A bladder or "envelope" is often utilized to confine the composite material of this invention. The bladder may be fabricated from any flexible film like material that is inert to the composition itself and or its individual components. Useful films include: polyurethane, polyvinyl chloride and polyolefins. Preferably the material used to construct the bladder will be heat or radio frequency seal able to provide a substantially impervious seal, which prevents leakage of composite material. It is also important that the bladder material be durable and retains its flexible, pliable properties over a useful temperature range for extended periods of time.

EXAMPLE 8

The following example demonstrates the principle of this invention that the addition of a small fraction of very high molecular weight polymer to a very low molecular weight polymer system will greatly alter the visco-elastic response of that polymer system. The following formulations were prepared by the method outlined in Example 1.

| | FORMULATION | | |
|---|---|---|---|
| | A | B | C |
| PB950 | 99 | 98 | 95 |
| VHMW BLEND | 1 | 2 | 5 |
| PB 950 | 99 | 98 | 95 |
| LOW MW IN BLEND | 0.95 | 1.90 | 4.75 |
| VERY HIGH MW IN BLEND | 0.05 | 0.10 | 0.25 |

The upper table represents the amount of the blend of high and low molecular weight polymer utilized. The lower table represents the actual amount of very high molecular weight polymer in each sample based on a blend of 95/5, low to high molecular weight polymer. For comparison purposes, PB 950 (MW 950) was utilized as the control.

Dynamic viscoelastic data was generated using a Rheometrics System Four instrument equipped with 50 mm diameter parallel plates, a forced oscillatory strain of thirty percent, and a variable gap setting, ranging from about 0.750 mm to slightly more than 1.4 mm. The strain input was adjusted via the microprocessor/controller to ensure a constant strain amplitude corresponding to 30%. The response of the samples to alternating strain can be described by a complex dynamic shear viscosity n*, where $$n^*=n'+in''$$

The parameter n' (poise) is called the dynamic viscosity and is a function of frequency w (rad/sec) in essentially the same way as the steady shear viscosity n is a function of shear rate. The parameter n" is found to be a measure of elastic response of the material.

Figure 2:
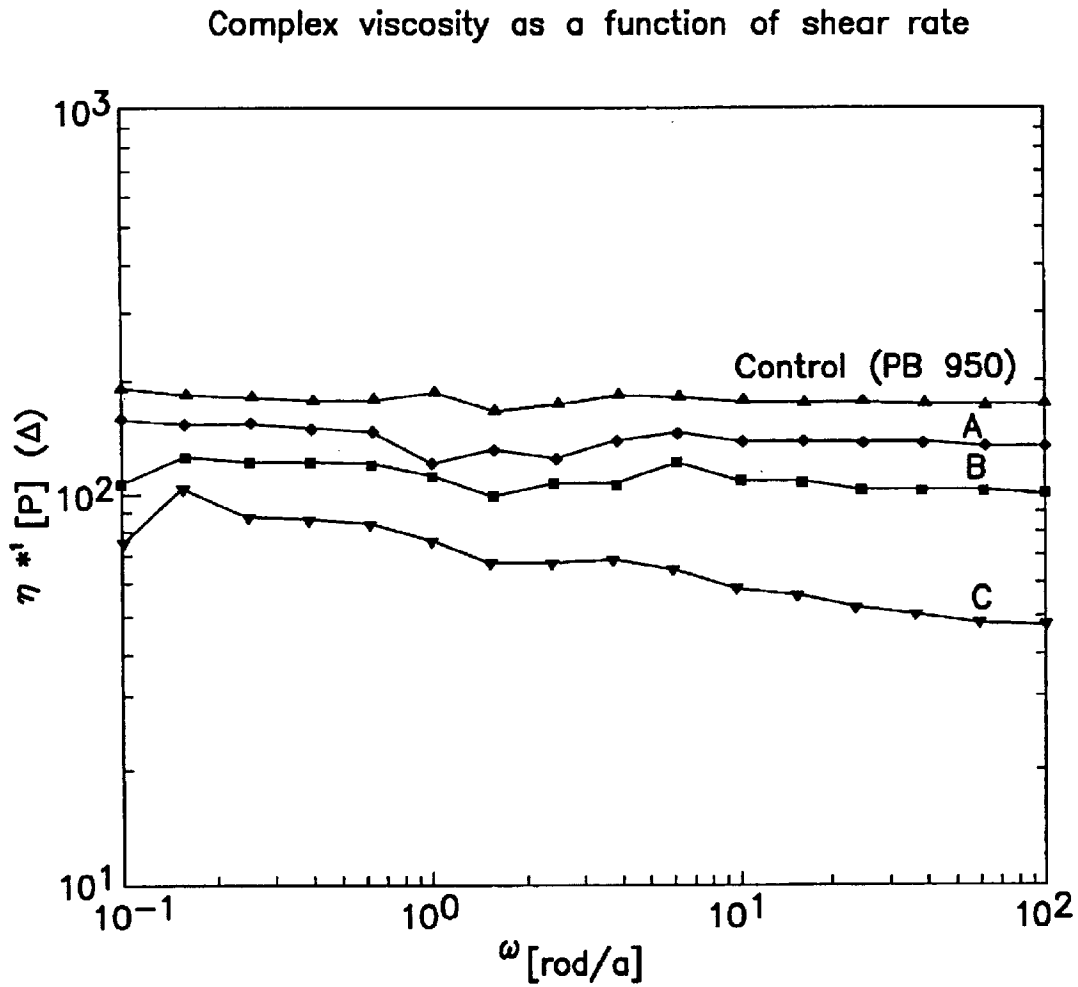
FIG. 2 is a graph shown viscosity as a funtion of shear rate.

FIG. 2 represents a plot of complex viscosity (n*) versus shear rate (w) with all data generated at room temperature. It can be seen that all the samples including the control exhibited near Newtonian behavior. From the position of the curves it is evident that the addition of the very high molecular weight polymer did not increase the complex viscosity but in fact decreased it. This is more pronounced at the high strain rates.

The response of the samples to alternating strain can also be described by a complex shear modulus, G*, where:

$$G^*=G'+iG''$$

The parameter G' is called the elastic component of the shear modulus and G" is a measure of the energy dissipation. Table 3 presents this elastic component of the shear modulus G' (dynes/cm$^2$) at selected frequencies w (rad/sec).

TABLE 3

| | G' (dynes/cm$^2$) | | |
|---|---|---|---|
| MATERIAL | 1.0 rad/sec | 10.0 rad/sec | 100 rad/sec |
| CONTROL PB950 | 0 | 21.83 | 100.6 |
| SAMPLE A | 7.474 | 42.39 | 243.4 |
| SAMPLE B | 7.786 | 65.41 | 300.2 |
| SAMPLE C | 13.61 | 113.70 | 658.9 |

These data illustrate the basic principle on which this invention relies. At a low shear rate (1.0 rad/sec) the elastic shear modulus is 0 for the control, but increases dramatically with just the addition of 0.05% very high molecular weight polymer. Increasing the amount to 0.25% results in an elastic shear modulus of 13.61. This effect carries over at higher shear rates (10 and 100 rads/sec) with the elastic shear modulus increasing nearly 6 fold with the addition of only 0.25% very high molecular weight polymer control.

This example demonstrates the utility of this invention in that adding small amounts of very high molecular weight polymer to a low molecular weight polymer system can greatly increase the elastic component of the shear modulus resulting in improved resistance of the compositions of this invention to separation, improved resistance to deformation and increased ability to rebound from recovery. A further advantage is that these property improvements are gained with no increase in viscosity, a very desirable attribute from the manufacturing standpoint. Unlike the prior art, the material exhibits minimal or no change in rheology even with temperature change (such as from room temperature to body temperature).

What is claimed is:

1. A composite material suitable for use in cushioning and padding applications comprising:

a. a petroleum hydrocarbon fluid as the vehicle;

b. a rheology modifier selected from the group consisting of poly-1-butene and polyisobutylene; and c. microspheres.

2. The composite material of claim 1, wherein said petroleum hydrocarbon fluid is selected from the group consisting of saturated polyalphaolefins and polyisobutylene.

3. The composite material of claim 1, wherein said rheology modifier has a molecular weight of about 750,000 to about 5,000,000.

4. The composite material of claim 1, wherein said rheology modifier is polyisobutylene having a molecular weight of about 1,000,000.

5. The composite material of claim 1, wherein said rheology modifier is dissolved in a lower molecular weight fluid selected from the group consisting of mineral oil and polybutene.

6. The composite material of claim 1, wherein said microspheres are selected from the group consisting of plastic, glass, ceramic microspheres and mixtures thereof.

7. The composite material of claim 1, wherein said petroleum hydrocarbon fluid is polyisobutylene or poly-1-butene of molecular weight 400 to 8,000.

8. The composite material of claim 1, wherein said microspheres have plastic walls with a uniform wall thickness and spherical configuration.

9. The composite material of claim 1, wherein said microspheres have a specific gravity that ranges from 0.02 gm/cc to 0.20 gm/cc.

10. The composite material of claim 1, wherein said microspheres have a diameter of from 10 to 250 microns.

* * * * *